US006628906B2

(12) United States Patent
Kimizuka

(10) Patent No.: US 6,628,906 B2
(45) Date of Patent: Sep. 30, 2003

(54) IMAGE FORMING APPARATUS WITH TEMPERATURE BASED CONTROL

(75) Inventor: Eiichiro Kimizuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,711

(22) Filed: Nov. 6, 2001

(65) Prior Publication Data

US 2002/0054770 A1 May 9, 2002

(30) Foreign Application Priority Data

Nov. 8, 2000 (JP) ..... 2000-340994

(51) Int. Cl.[7] ..... G03G 15/00
(52) U.S. Cl. ..... 399/44; 399/92; 399/93
(58) Field of Search ..... 399/38, 44, 91, 399/92, 93, 97, 98

(56) References Cited

U.S. PATENT DOCUMENTS

| | | | | |
|---|---|---|---|---|
| 4,720,727 A | * | 1/1988 | Yoshida | 399/93 |
| 5,128,717 A | * | 7/1992 | Uchikawa et al. | 399/44 |
| 5,148,226 A | | 9/1992 | Setoriyama et al. | 399/329 |
| 5,162,634 A | | 11/1992 | Kusaka et al. | 219/216 |
| 5,210,579 A | | 5/1993 | Setoriyama et al. | 399/338 |
| 5,262,834 A | | 11/1993 | Kusaka et al. | 399/329 |
| 5,525,775 A | | 6/1996 | Setoriyama et al. | 219/216 |
| 6,047,144 A | * | 4/2000 | Sasai et al. | 399/44 |
| 6,173,132 B1 | * | 1/2001 | Kida et al. | 399/44 |
| 6,192,203 B1 | * | 2/2001 | Nishio et al. | 399/44 |
| 6,336,010 B1 | * | 1/2002 | Kuwabara | 399/68 |

FOREIGN PATENT DOCUMENTS

| | | |
|---|---|---|
| JP | 2-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |

* cited by examiner

*Primary Examiner*—Hoan Tran
(74) *Attorney, Agent, or Firm*—Fitzpatrick, Cella, Harper & Scinto

(57) ABSTRACT

There is provided an image forming apparatus that is capable of detecting an outside air temperature with high precision, which is capable of controlling the setting of an image forming condition to improve an image quality. A suction fan 10 and a thermistor 14 in the vicinity of an outside air (outside air intake) are disposed, and an enforced convection due to the fan 10 is utilized to detect the outside air temperature with high precision (high accuracy and high response), thereby being capable of obtaining that information.

16 Claims, 11 Drawing Sheets

IMAGE FORMING APPARATUS WITH TEMPERATURE BASED CONTROL

BACKGROUND OF THE INVENTION

1. Field of the Invention

The present invention relates to an image forming apparatus such as a copying machine or a printer, and more particularly to an image forming apparatus having a temperature detecting device for controlling an image forming condition.

2. Description of the Related Art

Hitherto, as the image forming apparatus of this type, there is known an image forming apparatus using the electrophotographic system such as a laser printer or a copying machine. Hereinafter, the image forming apparatus of the electrophotographic process will be described with reference to FIG. 12. FIG. 12 is a schematic cross-sectional view showing an image forming apparatus as background art.

A recording medium 102 set in a paper feed cassette 103*a* is transported to a transfer position by a pick-up roller 103*b*, a pair of feed and retard rollers 103*c*, a pair of conveying rollers 103*d* and a pair of conveying rollers 103*e*. A transfer roller 104 is located at the transfer position as a transferring means, and a toner image on a photosensitive drum 107 is transferred onto the recording medium 102 by applying a voltage thereto.

In this example, the photosensitive drum 107 is charged by a charging means 108, and then a laser beam is irradiated onto the photosensitive drum 107 from an optical means 101 to form a latent image corresponding to image information on the photosensitive drum 107. The latent image is developed by a developing means 109 into a visible image, that is, a toner image.

The recording medium 102 onto which the toner image has been transferred is conveyed to a fixing means 105 through a conveyance belt 103*f*. The fixing means 105 applies heat and pressure to the recording medium 102 that is passing through the fixing means 105, to thereby fix the transferred toner image onto the recording medium 102.

In particular, in the case where the fixing means 105 is of the film heating system (disclosed in Japanese Patent Application Nos. Sho 63-313282, Hei 2-157878, Hei 4-44075 to 44083, Hei 4-204980 to 204984, and so on), a structure is made in which a heat-resistant film (heat-resistant fixing film) which is a rotary member for heating is brought in close contact with a heating member by a rotary member for pressurizing (elastic roller) which is a pressure member.

A pressured contact nip portion is formed at a portion of the heat-resistant fixing film which is nipped between the heating member and the pressure member, and the recording medium 102 that bears an unfixed image is introduced between the heat-resistant fixing film and the pressure member at the pressure contact nip portion. Then, the recording medium 102 is conveyed together with the heat-resistant fixing film, and the unfixed image is subjected to heat from the heating member and to pressure from the pressure member, which are given through the heat-resistant fixing film, to thereby fix the unfixed image on the recording medium 102 as a permanent image.

Thereafter, the recording medium 102 is conveyed by a pair of discharge rollers 103*g* and a pair of discharge rollers 103*h* and then discharged to a discharge tray 106.

In this example, a thermistor (not shown) is disposed within the fixing means 105, and a temperature is adjusted on the basis of the detected temperature information to determine an appropriate fixing temperature. Also, appropriate transfer control is conducted on the basis of current or voltage information when the recording medium 102 is nipped or not nipped between the photosensitive drum 107 and the transfer roller 104.

In this way, there is applied a system in which feedback is effected on the basis of the information within the control unit since the recording medium 102 mainly reaches the control means such as the transfer roller 104 or the fixing means 105.

Also, a fan 110 is disposed on a side surface of an image forming apparatus so that outside air is taken in and supplied to an air path formed in the apparatus to suppress a rise of a temperature within the apparatus.

However, the above-mentioned apparatus suffers from the following problems.

When the above-mentioned image forming apparatus is liable to be influenced by a temperature environment where the image forming apparatus is used, an excess of quantity of heat or a lack of quantity of heat is liable to be caused. In particular, in the case where the fixing means is of the film heating system, a low heat capacity linear heating member is employed as the heating member, and a thin-film and low heat capacity material is employed as the film. As a result, although an electric power can be saved and a wait time can be reduced, the image forming apparatus is liable to be influenced by the temperature environment where the image forming apparatus is used, and the excess of quantity of heat or a lack of quantity of heat is liable to be caused.

In case of an excess of heat quantity, a part of toner image remains on the film side, resulting in the possibility of occurring an image failure where the toner is transferred onto the recording medium after the film has made a round. On the other hand, in the case of a lack of heat quantity, there is the possibility of occurring fixing failure.

In this way, when the temperature of the outside air cannot be detected with high response and accuracy, appropriate fixing temperature control that takes the temperature of the outside air into account cannot be conducted.

Also, in the case where transfer bias control is conducted, if the temperature of the outside air cannot be detected with high response and accuracy, appropriate transfer bias control that takes the temperature of the outside air into account cannot be conducted as with the fixing temperature control. This also leads to the fear of the image failure.

SUMMARY OF THE INVENTION

The present invention has been made under the above-mentioned circumstances, and therefore an object of the present invention is to provide an image forming apparatus which is capable of detecting the temperature of outside air with high precision, and is capable of controlling a setting of an image forming condition corresponding to the outside air temperature to improve its image quality.

Another object of the present invention is to provide an image forming apparatus comprising: an image forming means for forming an image on a recording material; a temperature sensor that detects a temperature; and an outside air take-in means for taking in and supplying outside air to the apparatus through an intake; wherein the condition of the image forming means is controlled on the basis of an output from the temperature sensor, and the temperature sensor is disposed in the vicinity of the intake.

Other objects of the present invention will become apparent from the following description.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings. In the following description, the scope of the present invention is not limited to only the dimensions, the materials, the shapes, the relative arrangements, and so on of structural parts described in the embodiments so far as there is no specific description.

First Embodiment

Figure 1:
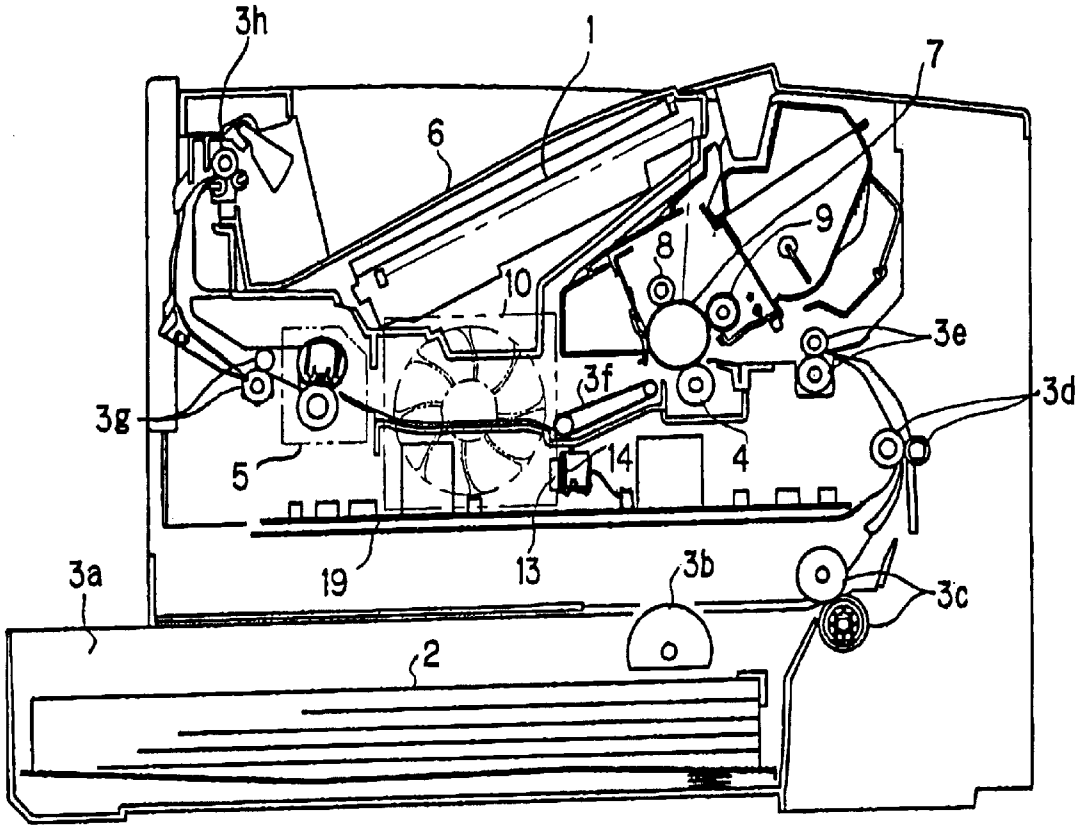
FIG. 1 is a schematic cross-sectional view showing an image forming apparatus in accordance with an embodiment of the present invention.

An image forming apparatus in accordance with a first embodiment of the present invention will be described with reference to FIGS. 1 to 3.

First, the entire image forming apparatus will be described particularly with reference to FIG. 1. FIG. 1 is a schematic cross-sectional view showing an image forming apparatus in accordance with an embodiment of the present invention.

A recording medium (sheet) 2 which is a recording material set in a sheet feed cassette 3*a* is fed by a pick-up roller 3*b*. Then, the recording medium 2 is separated one by one by a pair of feed and retard rollers 3*c* and then fed. Then, the recording medium 2 is conveyed to a transfer position by a pair of conveying rollers 3*d* and a pair of conveying rollers 3*e*.

A transfer roller 4 is disposed at the transfer position as a transferring means, and a toner image on a photosensitive drum 7 that serves as an image bearing member is transferred onto the recording medium 2 by applying a voltage (transfer bias) thereto.

In this example, the photosensitive drum 7 is charged by a charging means 8, and then a laser beam is irradiated onto the photosensitive drum 7 from an optical means 1 to form a latent image corresponding to image information on the photosensitive drum 7. The latent image is developed by a developing means 9 into a visible image, that is, a toner image (unfixed image).

The recording medium 2 onto which the toner image has been transferred is conveyed to a fixing means 5 through a conveyance belt 3*f*. The fixing means 5 applies heat and pressure to the recording medium 2 that is passing through the fixing means 5, to thereby fix the transferred toner image (unfixed image) onto the recording medium 2.

In particular, in the case where the fixing means 5 is of the film heating system, a structure is made in which a heat-resistant film (heat-resistant fixing film) which is a rotary member for heating is brought in close contact with a heating member by a rotary member for pressurizing (elastic roller) which is a pressure member.

A pressured contact nip portion is formed at a portion of the heat-resistant fixing film which is nipped between the heating member and the pressure member, and the recording medium 2 that bears an unfixed image is introduced between the heat-resistant fixing film and the pressure member at the pressure contact nip portion. Then, the recording medium 2 is conveyed together with the heat-resistant fixing film, and the unfixed image is subjected to heat from the heating member and to pressure from the pressure member, which are given through the heat-resistant fixing film, to thereby fix the unfixed image on the recording medium 2 as a permanent image.

In this way, the image forming means for forming an image on the recording medium 2 is structured by the photosensitive drum 7 as well as the charging means 8, the optical means 1, the developing means 9 and the transfer roller 4 which are disposed around the photosensitive drum 7, and the fixing means 5.

Thereafter, the recording medium 2 is conveyed by the pair of discharge rollers 3*g* and the pair of discharge rollers 3*h* and then discharged to the discharge tray 6.

Also, a fan 10 is disposed on a side surface of the image forming apparatus main body as an outside air take-in means, and takes in and supplies the outside air to an air path formed within the apparatus to suppress a rise of the temperature within the apparatus.

Figure 2:
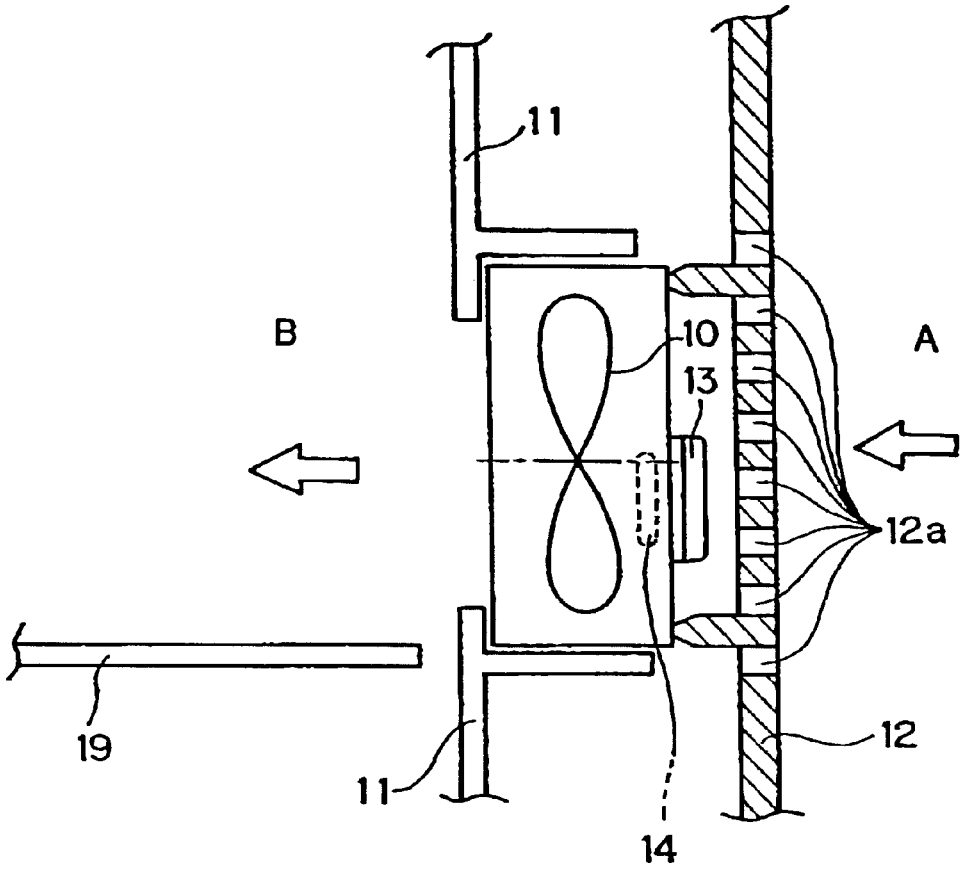
FIG. 2 is a schematic cross-sectional view showing the neighborhood of a fan in the image forming apparatus in accordance with the embodiment.

As shown in FIG. 2, the fan 10 is caught by a frame 11 within the apparatus main body and functions to suck the outside air and send it into the apparatus main body during operation. The outside air is sent to an inside B of the apparatus from an outside A of the apparatus through a louver 12*a* that serves as an outside air intake (opening portion) opened in an exterior member 12 as indicated by an arrow.

Figure 3:
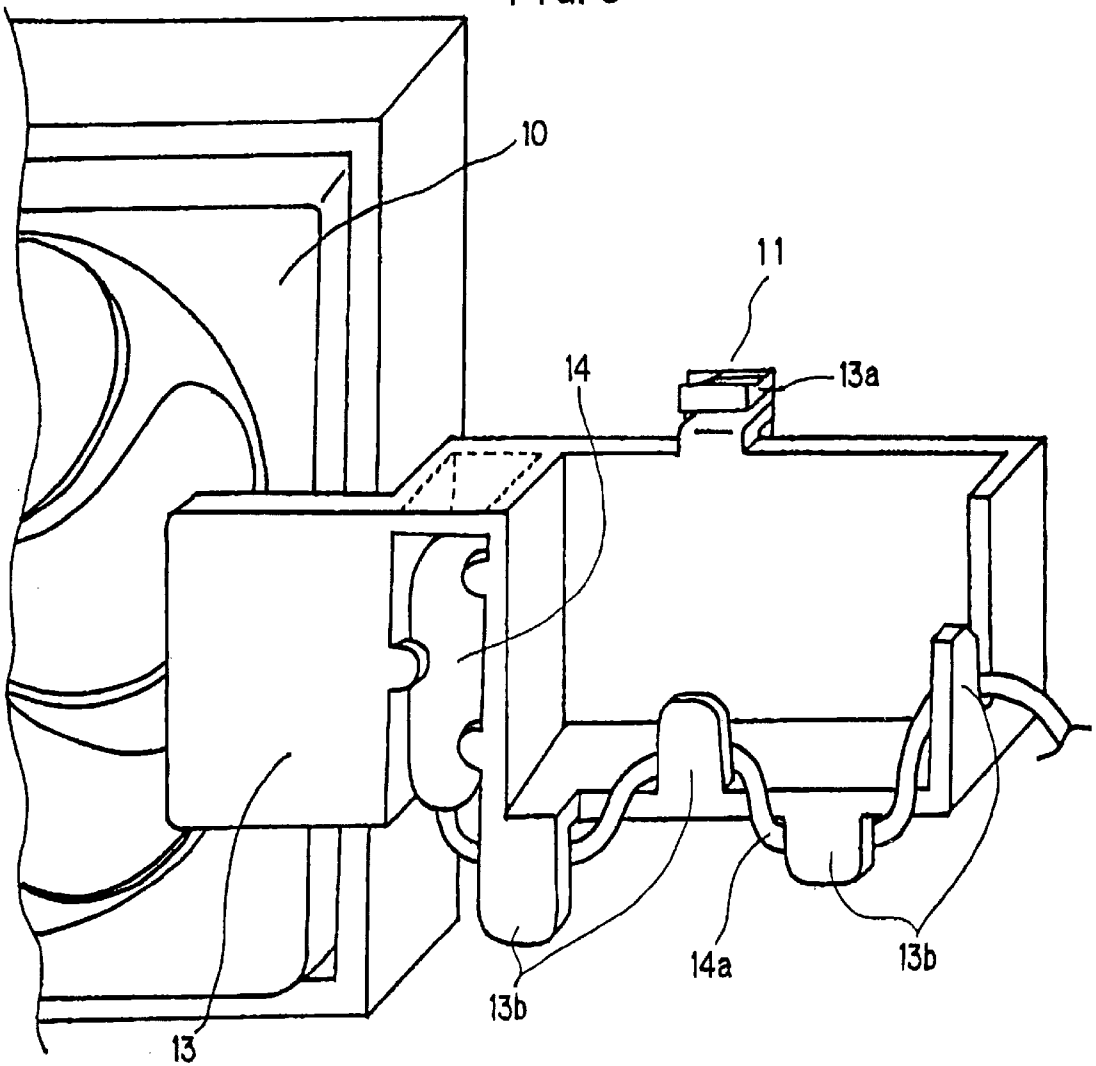
FIG. 3 is a schematic perspective view showing the neighborhood of a fan in the image forming apparatus in accordance with the embodiment.

Also, as shown in FIG. 3, the position of the fan 10 is regulated by a fan retention member 13, and the fan retention member 13 is fixed to the frame 11 by its engagement portion 13*a*.

The fan retention member 13 is fitted with a thermistor 14 that is an outside temperature detecting sensor (outside temperature detecting device). Also, in the fan retention member 13, a conductor 14*a* of the thermistor 14 sinuates along hook ribs 13*b* of the fan retention member 13.

With the above structure, in this embodiment, the suction fan 10 and the thermistor 14 in the vicinity of the outside air (outside air intake) are disposed to utilize an enforced convection due to the fan 10 to detect the outside air temperature with high precision (accurately and high response), thereby being capable of obtaining that information. Also, the support structure of the thermistor can be simplified without provision of an exclusive thermistor support member.

Figure 4:
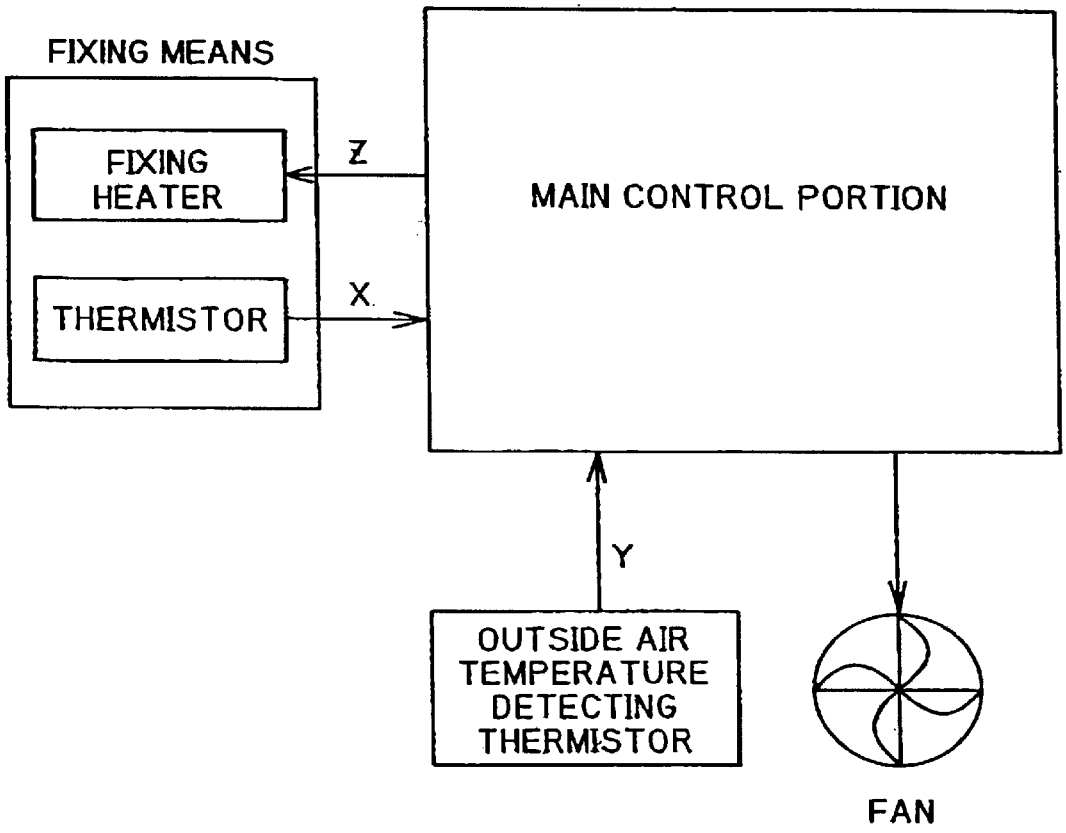
FIG. 4 is a block diagram showing a main control portion of the image forming apparatus in accordance with the embodiment.

The main control potion that serves as a control means for controlling the image forming apparatus main body conducts appropriate energization control (Z) to the fixing heater portion on the basis of temperature information (X) of the fixing portion obtained through a fixing portion thermistor disposed within the fixing means 5 as shown in a block diagram of FIG. 4 and outside air temperature information (Y) obtained through the above thermistor 14, thereby being capable of appropriately adjusting the temperature of the fixing heater portion (setting the heat temperature). Therefore, the image defect caused by an influence of the outside air temperature can be prevented.

Also, in the transfer bias control, with grasping the outside air temperature information, it is possible to determine an appropriate transfer bias taking the outside air temperature into consideration. In addition, it is possible that the rotation speed of the fan is changed on the basis of the outside air temperature information (adjustment of the outside air take-in amount) to stabilize the temperature within the apparatus.

Although there is proposed that the above-mentioned thermistor 14 is disposed in the vicinity of the outside air and on an electric equipment board 19, there is the possibility that the thermistor 14 is influenced by a rise of the temperature of the board per se in this case, and, for example, taking a response of until the temperature in the vicinity of the thermistor 14 becomes constant since the fan turns on into account, a precision of detection in this embodiment is superior to that in the above proposal.

Figure 5:
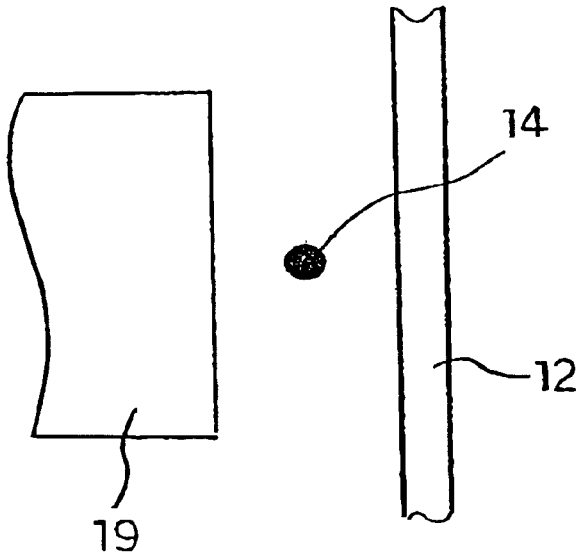
FIG. 5 is a schematic view showing a relationship of an arrangement of a main portion of the image forming apparatus in accordance with the embodiment.
Figure 6:
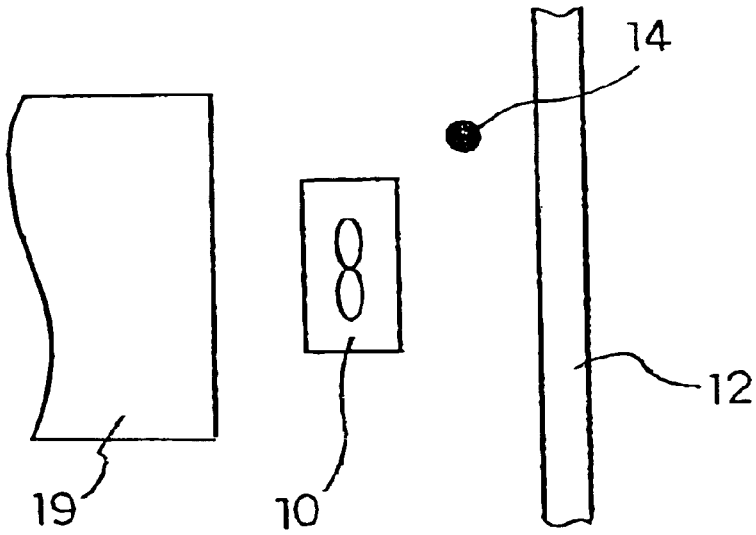
FIG. 6 is a schematic view showing a relationship of an arrangement of a main portion of the image forming apparatus in accordance with the embodiment.

Hereinafter, a description will be given of an example in which the thermistor 14 is so disposed as not to be thermally influenced by the electric equipment board 19 with reference to FIGS. 5 and 6. FIGS. 5 and 6 are schematic views (top perspective views) showing a relationship of the arrangements of the respective portions by projecting the apparatus main body from a vertical direction.

As shown in FIG. 5, it is preferable that the thermistor 14 is disposed between the electric equipment board 19 and the exterior member 12 in a horizontal direction.

With this arrangement, because the outside air is sent into the interior of the apparatus through the louver 12*a* that serves as the outside air intake (opening portion) opened in the exterior member 12 (not shown in FIG. 5), it is possible to reduce an influence of the heat emitted from the electric equipment board 19 on the thermistor 14.

Also, it is more preferable to dispose the fan 10, which generates an airflow toward the inner side from the outer side between the electric equipment board 19 and the thermistor 14 in the horizontal direction as shown in FIG. 6.

As a result, it is possible to more effectively reduce the influence of the heat generated from the electric equipment board 19 on the thermistor 14.

Second Embodiment

Figure 7:
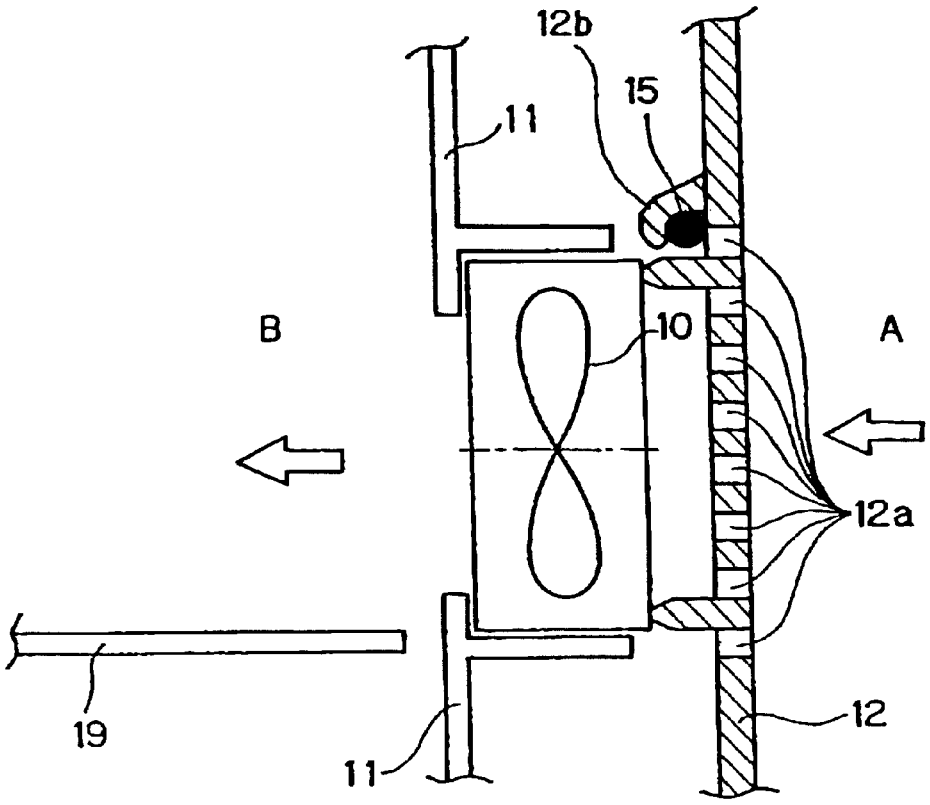
FIG. 7 is a schematic cross-sectional view showing the neighborhood of a fan in the image forming apparatus in accordance with another embodiment.

The above-mentioned first embodiment is applied to the structure in which the temperature detecting sensor that detects the temperature of the outside air is fitted to the fan retention member. In a second embodiment, a structure in which the temperature detecting sensor is fitted to the exterior member will be described with reference to FIG. 7.

The same structures and actions as those in the first embodiment will be omitted from description.

This embodiment is different from the above-mentioned first embodiment in that a thermistor 15 that detects the outside air temperature is disposed on the exterior member 12. The thermistor retention portion 12*b* is disposed on the exterior member 12, and the thermistor 15 is engaged with the thermistor retention portion 12*b*.

Similarly, in this embodiment, the support structure of the thermistor can be simplified without provision of an exclusive thermistor support member, and also the suction fan 10 and the thermistor 15 in the vicinity of the outside air (outside air intake) are disposed to utilize an enforced convection due to the fan 10 to detect the outside air temperature with high precision, thereby being capable of obtaining that information. As a result, the same effects as those in the first embodiment are obtained.

Third Embodiment

An image forming apparatus in accordance with a third embodiment of the present invention will be described with reference to FIG. 8. The above-mentioned first embodiment is applied to the structure in which the temperature detecting sensor that detects the temperature of the outside air is fitted to the fan retention member. In this embodiment, a structure in which the temperature detecting sensor is fitted to a filter member that prevents the penetration of a foreign material when the temperature detecting sensor takes in the outside air due to the fan will be described.

Since other structures and actions are identical with those in the first embodiment, the same structures are designated by like references, and their description will be appropriately omitted.

Figure 8:
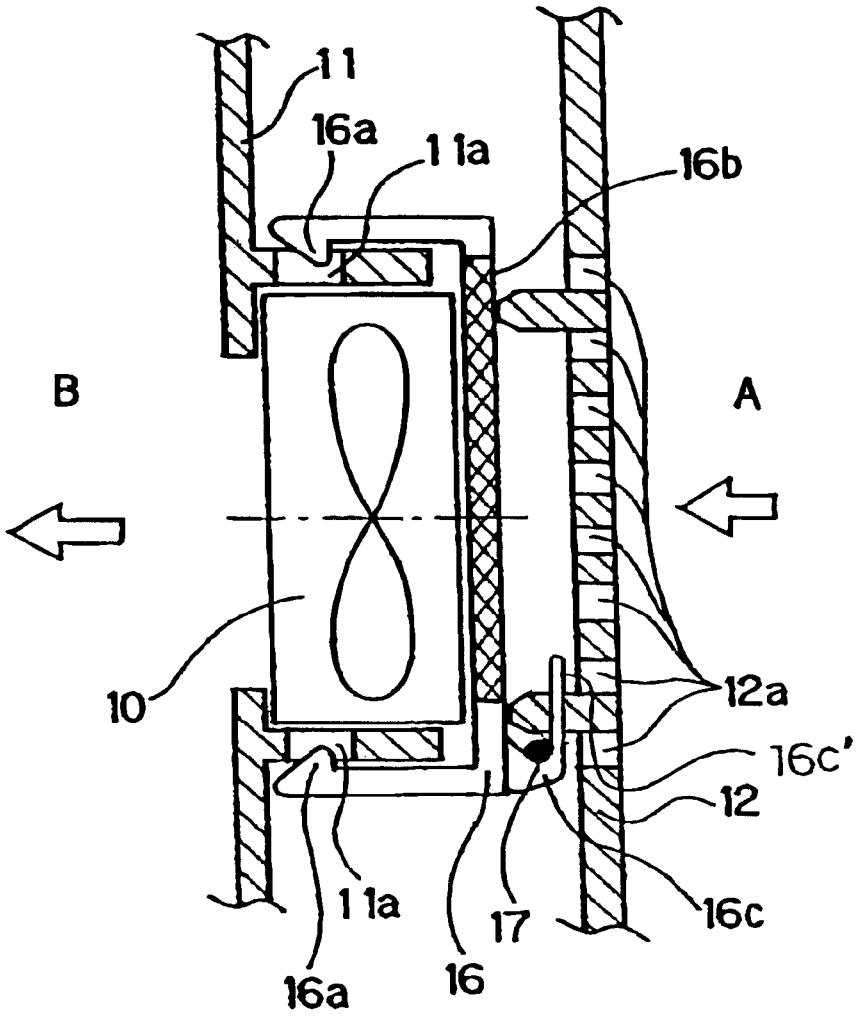
FIG. 8 is a schematic cross-sectional view showing the neighborhood of a fan in the image forming apparatus in accordance with still another embodiment.

FIG. 8 is a schematic cross-sectional view showing the main portion of an image forming apparatus in accordance with a third embodiment of the present invention.

In this embodiment, a dustproof filter member 16 is fixed by engaging a filter claw portion 16*a* with a hole portion 11*a* of the frame 11. A mesh-shaped filter portion 16*b* is disposed between the fan 10 and the exterior member 12.

This embodiment is different from the above-mentioned first embodiment in that a thermistor 17 that detects the outside air temperature is engaged with a thermistor holding portion 16*c* of the filter member 16.

Similarly, in this embodiment, the support structure of the thermistor can be simplified without provision of an exclusive thermistor support member, and also the suction fan 10 and the thermistor 17 in the vicinity of the outside air (outside air intake) are disposed to utilize an enforced convection due to the fan 10 to detect the outside air temperature with high precision, thereby being capable of obtaining that information. As a result, the same effects as those in the first embodiment are obtained.

Also, the present invention is not limited to this embodiment, but it is desirable that an insulating portion 16*c*' is disposed between the louver 12*a* and the thermistor 17 to gain a creepage distance for insulation, taking a destruction by static electricity into account.

Fourth Embodiment

Figure 9:
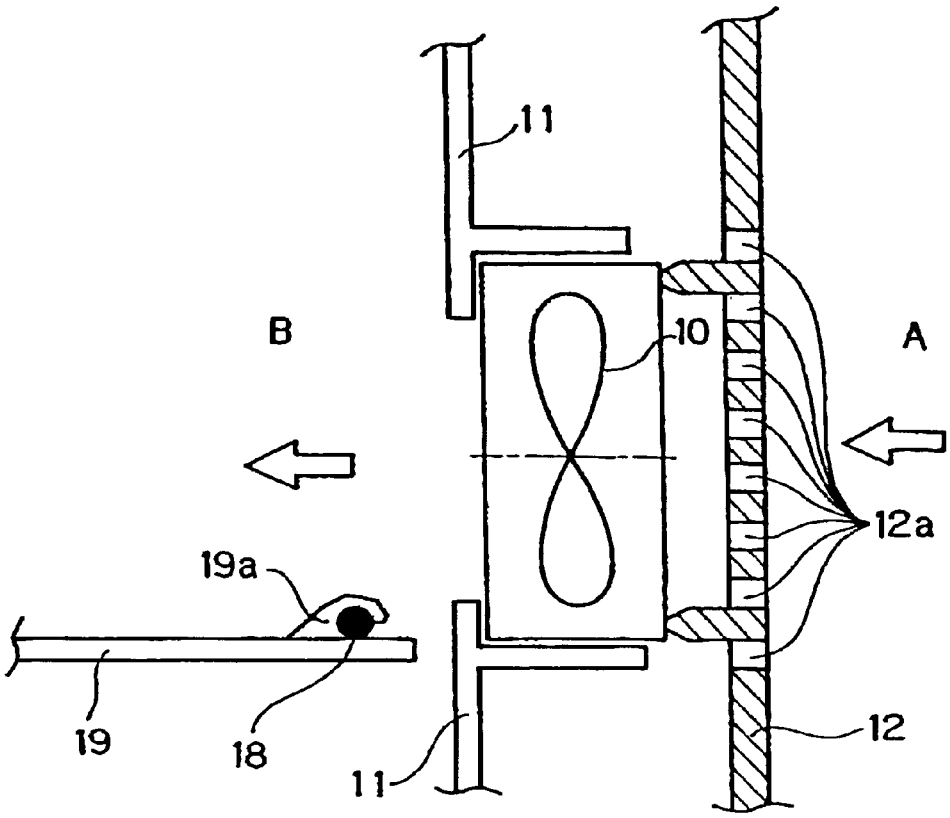
FIG. 9 is a schematic cross-sectional view showing the neighborhood of a fan in the image forming apparatus in accordance with yet still another embodiment.

The above-mentioned first embodiment is applied to the structure in which the temperature detecting sensor that detects the temperature of the outside air is fitted to the fan retention member. In a fourth embodiment, a structure in which the temperature detecting sensor is fitted onto an electric equipment board in the case where the electric equipment board hardly generates heat will be described with reference to FIG. 9.

The same structures and actions as those in the first embodiment will be omitted from description.

This embodiment is different from the above-mentioned first embodiment in that a thermistor 18 that detects the outside air temperature is engaged with a thermistor retention portion 19*a* of the electric equipment board 19.

Similarly, in this embodiment, the support structure of the thermistor can be simplified without provision of an exclusive thermistor support member, and also the suction fan 10 and the thermistor 18 in the vicinity of the outside air (outside air intake) are disposed to utilize an enforced convection due to the fan 10 to detect the outside air temperature with high precision, thereby being capable of obtaining that information.

Fifth Embodiment

Figure 10:
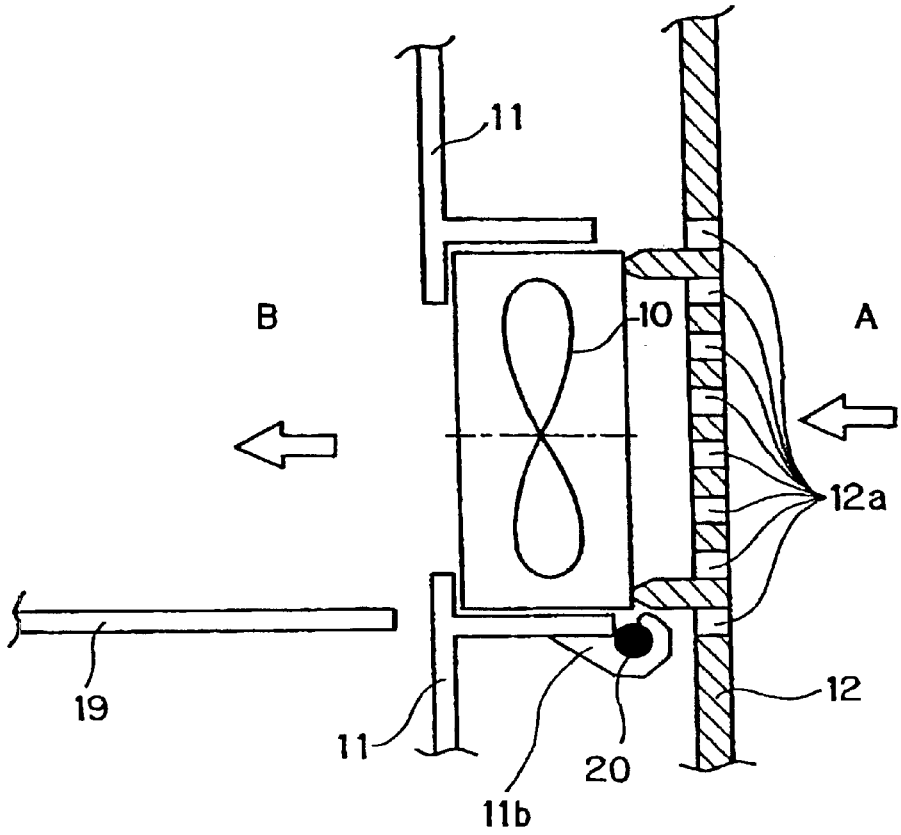
FIG. 10 is a schematic cross-sectional view showing the neighborhood of a fan in the image forming apparatus in accordance with yet still another embodiment.

The above-mentioned first embodiment is applied to the structure in which the temperature detecting sensor that detects the temperature of the outside air is fitted to the fan retention member. In a fifth embodiment, a structure in which the temperature detecting sensor is fitted onto a main body frame will be described with reference to FIG. 10.

The same structures and actions as those in the first embodiment will be omitted from description.

This embodiment is different from the above-mentioned first embodiment in that a thermistor 20 that detects the outside air temperature is engaged with a thermistor retaining 11*b* of the frame 11.

Similarly, in this embodiment, the support structure of the thermistor can be simplified without provision of an exclusive thermistor support member, and also the suction fan 10 and the thermistor 20 in the vicinity of the outside air (outside air intake) are disposed to utilize an enforced convection due to the fan 10 to detect the outside air temperature with high precision, thereby being capable of obtaining that information. As a result, the same effects as those in the first embodiment are obtained.

Sixth Embodiment

An image forming apparatus in accordance with a sixth embodiment of the present invention will be described with reference to FIG. 11. In the above-mentioned respective embodiments, there are shown cases in which the fan that allows an airflow to be generated from the outer side of the apparatus toward the inner side thereof is applied. In this embodiment, a structure in which a fan that allows an airflow to be generated from the inner side of the apparatus toward the outer side thereof will be described.

Since other structures and actions are identical with those in the first embodiment, the same structures are designated by like references, and their description will be appropriately omitted.

Figure 11:
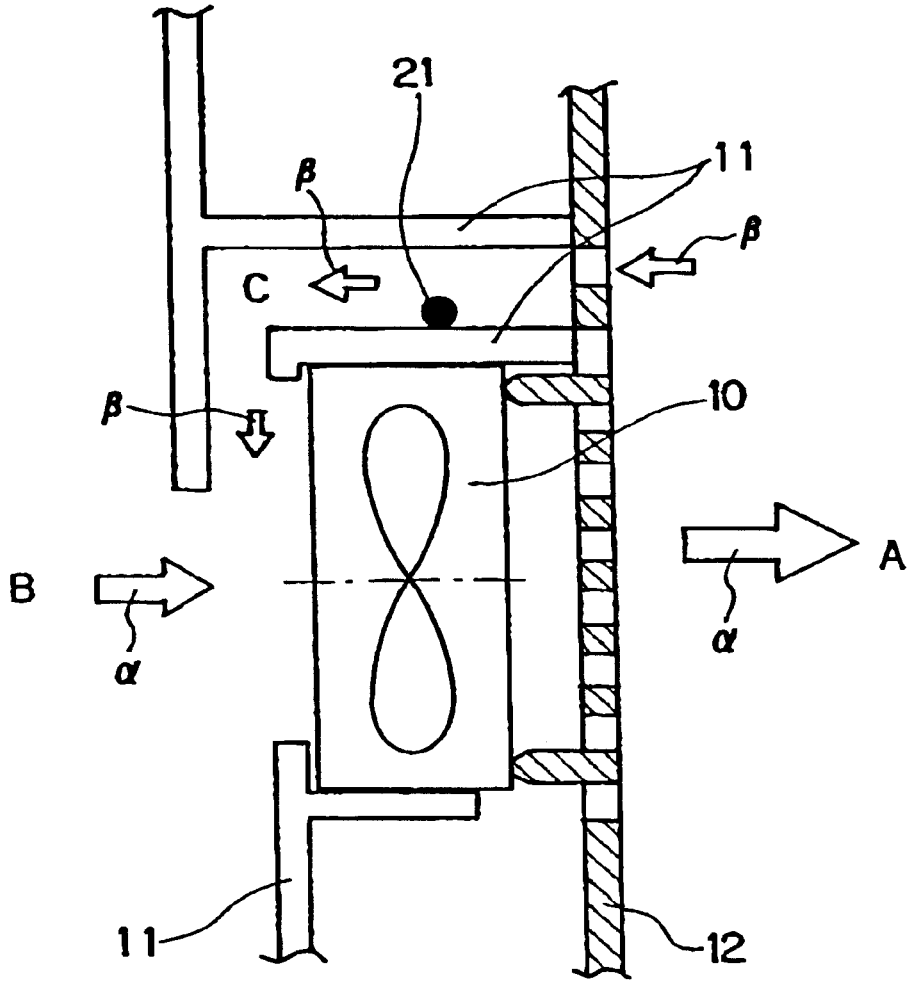
FIG. 11 is a schematic cross-sectional view showing the neighborhood of a fan in the image forming apparatus in accordance with yet still another embodiment.
Figure 12:
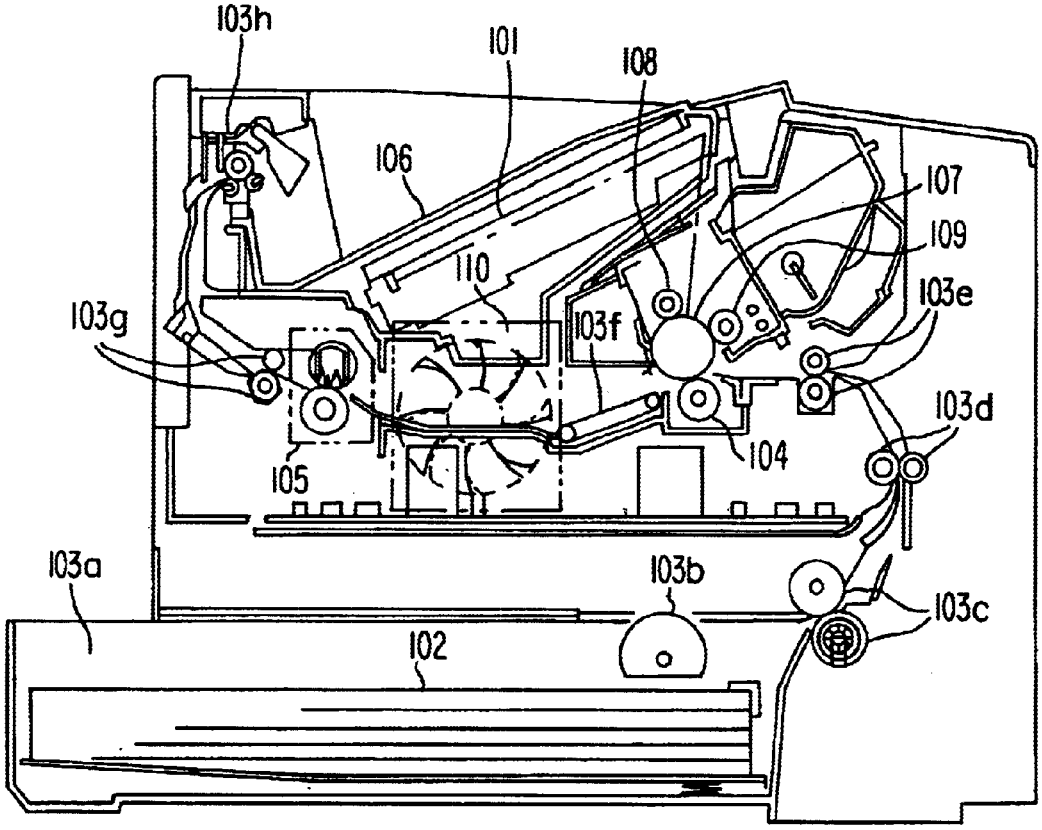
FIG. 12 is a diagram showing an image forming apparatus as background art.

FIG. 11 is a schematic cross-sectional view showing the main portion of an image forming apparatus in accordance with a sixth embodiment of the present invention.

The above-mentioned respective embodiments were described on the basis of the suction fan. However, in this embodiment, the fan 10 is designed to eject air within the apparatus from the interior of the apparatus B to outside air A through an exhaust port.

An outside air intake (opening portion) is so disposed as to be adjacent to the exhaust portion for exhausting an air by the fan 10 with a partition wall intervening disposed therebetween in the vicinity thereof.

Therefore, an air path C formed by the frame 11 is induced to a main flow á for exhausting the air through the exhaust port to take in the outside air from the outside air intake and generate a flow á.

A thermistor 21 that detects the outside air temperature is disposed within the air path C to detect the outside air temperature with high precision, thereby being capable of obtaining that information. As a result, the same effects as that in the first embodiment are obtained.

In the above description, the image formation conditions for conducting the control and setting on the basis of the detected outside air temperature relate to the adjustment of a heat temperature to the fixing means, the adjustment of the transfer bias, and the adjustment of the outside air intake by the fan (outside take-in means). However, it is needless to say that the present invention is not limited to this structure, but is applicable to various condition controls that influence the image quality directly or indirectly.

As was described above, according to the present invention, since the temperature detecting sensor is located in the vicinity of the outside air intake, the temperature of the outside air can be detected with high precision, and the setting of the image formation conditions is controlled by the control means on the basis of the detected temperature, thereby being capable of improving the image quality.

The above description was given of the embodiments of the present invention. However, the present invention is not limited to the above-mentioned embodiments and can be modified within the technical concept of the present invention.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

image forming means for forming an image on a recording material;

a temperature sensor that detects a temperature; and outside air take-in means for taking in and supplying outside air to said image forming apparatus through an intake, wherein a condition of said image forming means is controlled on the basis of an output from said temperature sensor, and wherein said temperature sensor is disposed in the vicinity of said intake.

2. An image forming apparatus according to claim 1, wherein said outside air take-in means is disposed in the vicinity of said intake, and generates an airflow toward an inner side of the apparatus from an outer side thereof through said intake.

3. An image forming apparatus as claimed in claim 2, wherein said temperature sensor is disposed in the vicinity of said outside air take-in means.

4. An image forming apparatus according to claim 1, further comprising a retention member for retaining said outside air take-in means, wherein said temperature sensor is disposed on said retention member.

5. An image forming apparatus according to claim 1, wherein said intake is disposed on an exterior of the apparatus, and said temperature sensor is disposed on the exterior of the apparatus.

6. An image forming apparatus according to claim 1, further comprising filtering means for filtering dust disposed in the vicinity of said outside air take-in means, wherein said temperature sensor is disposed on said filtering means.

7. An image forming apparatus according to claim 1, further comprising an electric equipment board, wherein said temperature sensor is disposed on said electric equipment board.

8. An image forming apparatus according to claim 1, further comprising a frame disposed in an interior of the apparatus, wherein said temperature sensor is disposed on said frame.

9. An image forming apparatus according to claim 1, wherein said outside air take-in means generates an airflow toward the outer side of the apparatus from an inner side thereof through an exhaust port, and takes in the outside air from said intake.

10. An image forming apparatus according to claim 9, wherein said intake is partitioned from said exhaust port by a wall.

11. An image forming apparatus according to claim 1, further comprising an electric equipment board, wherein said temperature sensor is disposed between said electric equipment board and an exterior of the apparatus in a horizontal direction.

12. An image forming apparatus according to claim 11, wherein said outside air take-in means is disposed between said electric equipment board and said temperature sensor in a horizontal direction.

13. An image forming apparatus according to claim 1, wherein said forming means includes transfer means for transferring an image on an image bearing member onto a recording material, wherein the condition of said transfer means is controlled on the basis of an output from said temperature sensor.

14. An image forming apparatus according to claim 1, wherein said image forming means includes fixing means for fixing an unfixed image onto a recording material, wherein the condition of said fixing means is controlled on the basis of an output from said temperature sensor.

15. An image forming apparatus according to claim 1, wherein the take-in amount of said outside air take-in means is controlled on the basis of an output from said temperature sensor.

16. An image forming apparatus according to claim 1, wherein said outside air take-in means comprises a fan.

* * * * *